United States Patent [19]

Alderson

[11] 3,979,908

[45] Sept. 14, 1976

[54] PRIORITY FLOW VALVE

[75] Inventor: Loren L. Alderson, Nickerson, Kans.

[73] Assignee: The Cessna Aircraft Company, Wichita, Kans.

[22] Filed: Sept. 29, 1975

[21] Appl. No.: 615,134

[52] U.S. Cl. ..... 60/422; 137/101

[51] Int. Cl.[2] ..... F15B 11/20

[58] Field of Search ..... 60/422; 137/101, 115, 137/596.12

[56] References Cited

UNITED STATES PATENTS

| | | | |
|---|---|---|---|
| 2,799,995 | 7/1957 | Herman | 60/422 X |
| 2,892,311 | 6/1959 | VanGerpen | 60/422 |
| 3,391,537 | 7/1968 | Smith | 60/422 |
| 3,916,932 | 11/1975 | Thorson | 60/422 |

*Primary Examiner*—Edgar W. Geoghegan
*Attorney, Agent, or Firm*—Edward L. Brown, Jr.

[57] ABSTRACT

A priority valve utilized in a pressure and flow compensated variable displacement system which supplies priority flow to a priority motor and secondary flow to a secondary motor as long as the priority flow requirements are satisfied or the priority flow path is blocked. The priority valve utilizes the same flow control signal as the system pump including a fixed restriction in the signal line and a relief valve downstream of said restriction, set at a level below the maximum pressure level of the system so that when the priority motor is stopped, flow continues to the secondary motor.

12 Claims, 1 Drawing Figure

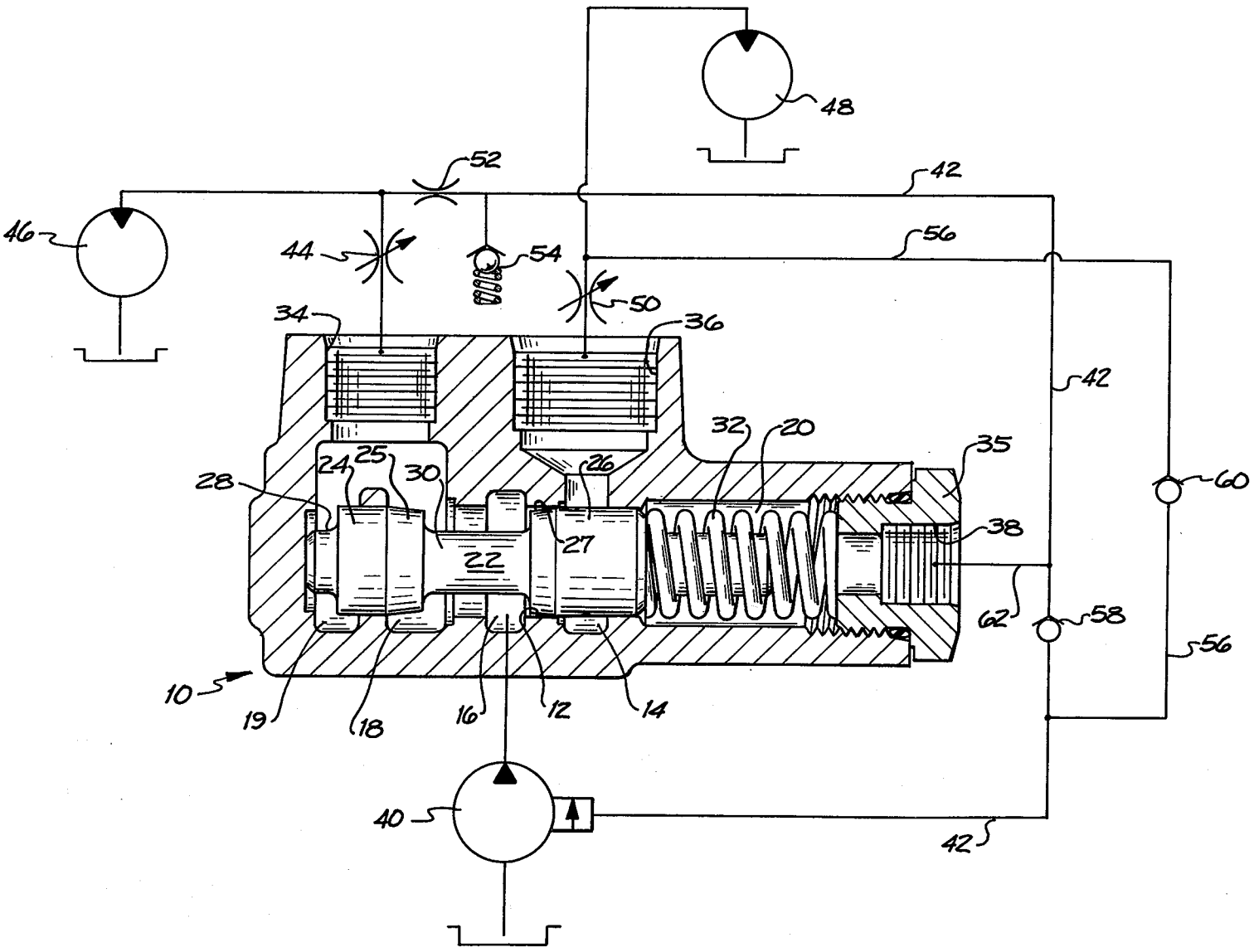
60
56
42
58
62
35
38
42
42
56
48
20
32
36
50
26
27
14
12
54
22
16
52
30
25
24
18
44
34
28
19
10
40
46

PRIORITY FLOW VALVE

BACKGROUND OF THE INVENTION

In modern variable displacement hydraulic systems, it quite often becomes necessary to provide an order of priority for the pump output, since the pump cannot supply all of the circuits of the system with their maximum flow requirements at the same time. For example, the power steering circuit of a mobile system must have priority over the other circuits of the system. Another example would be in a combine system where the reel motors must have priority over certain other functions. Likewise, the remaining functions may also require priority over each other so that each function of the system might have a different priority.

One method of providing priority flow based on pressure would be the use of a relief valve downstream of the priority function, or another similar method would be to vary the spring force on the load checks of a conventional valve. Another prior art method of obtaining priority flow would be the use of a flow divider valve such as taught in U.S. Pat. No. 3,229,717.

DESCRIPTION OF THE INVENTION

The priority flow control valve of the present invention can be utilized in a modern pressure flow compensated variable displacement system, also referred to in the art as a load responsive system. The valve also can be used in strictly pressure compensated systems or strictly flow compensated systems, likewise in open-center or closed-center systems. The valve is controlled by two opposing servo chambers which sense the pressure drop across a restriction in the priority flow path and accordingly position the priority valve spool to cut-off the secondary flow whenever the priority flow is insufficient and to reduce the priority flow if it becomes excessive in an overspeed situtation. The same signal which actuates the servo also controls the pump. When the priority flow is blocked, for example, when a piston in a cylinder bottoms out, it becomes impossible to satisfy the priority flow circuit and the pump goes to maximum pressure level. Prior to reaching that pressure level, a relief valve in the signal line opens creating a false flow signal to the priority valve servo. This false flow signal gives the indication of adequate priority flow and opens the secondary flow path to the pump even though there is no flow to the primary motor.

It is therefore the principal object of the present invention to provide a priority flow control valve in a load responsive system which permits secondary flow as long as the priority flow requirements are satisfied or the priority flow path is blocked and restricts the priority flow if it attempts to overspeed.

Another object of the present invention is to provide a priority flow control valve which can be used in either an open or closed-center hydraulic system.

The preferred embodiments of the invention are described herein in detail with reference to the accompanying drawing in which:

The lone drawing FIGURE is a sectional view of the priority flow control valve with the remainder of the hydraulic system shown schematically.

As shown in the drawing, the priority valve is generally described by reference numeral 10. The valve 10 includes a longitudinal bore 12 which intercepts the secondary outlet chamber 14, pump inlet chamber 16 and priority outlet chamber 18. The right end of bore 12 is enlarged to provide a servo chamber 20. Positioned in bore 12 is a valve spool 22 having lands 24 and 26 separated by annular groove 30. Both lands 24 and 26 include tapered edges 25 and 27 for improved metering. Other means such as notches can also be used. Valve spool 22 is held against the end of line bore 12 by compression spring 32 and plug 35. The priority flow exits from valve 10 through port 34 while the secondary flow exits through port 36. Port 38 provides signal line pressure to servo chamber 20.

The system is provided fluid by variable displacement pump 40. Pump 40 is a conventional axial piston variable displacement pump which is pressure and flow compensated of the type illustrated in U.S. Pat. No. 3,508,847. Likewise, strictly pressure compensated pumps or flow compensated pumps would work in the system. The pressure and flow compensating means of pump 40 are controlled by signal line 42 which senses the pressure in the priority flow path downstream from variable restriction 44. Priority motor 46 which could be any function in a hydraulic system, is provided with flow from valve 10 through port 34. Secondary motor 48 is provided from valve 10 through port 36 and is controlled by variable restriction 50. While in the preferred embodiment of the invention, variable restrictions 44 and 50 are conventional control valves, they could be replaced by any type of variable or fixed restriction means which would sense a pressure drop due to flow thereacross. Positioned in sensing line 42 is a fixed restriction 52 and a relief valve 54 set at a pressure level somewhat below the maximum system pressure provided by pump 40.

The secondary flow to motor 48 is sensed by sensing line 56 which provides pump 40 with the downstream pressure from restriction 50 via sensing lines 56 and 42. The pressure upstream of restriction 50 is sensed within the pump 40. Check valves 58 and 60 positioned in sensing lines 42 and 56 prevent any back flow in the sensing lines or cross flow between sensing lines 42 and 56. Sensing line 42 not only provides a signal for pump 40, but also via branch line 62 provides pressure in servo chamber 20 for actuating the priority valve 10.

OPERATION

Hydraulic fluid from pump 40 enters the priority valve at inlet chamber 16. In the absence of any flow to priority motor 46, there is no pressure drop across variable restriction 44 thereby providing equal pressures in the two opposing servo chambers 19 and 20 respectively, which are acting on opposite ends of valve spool 22. In the absence of any pressure differential, spring 32 maintains spool 22 in its far leftward position so that land 26 blocks any secondary flow into chamber 14. As the flow increases to motor 46, a pressure drop is achieved across restriction 44 causing a pressure increase in servo chamber 19 which is sensing the upstream pressure of restriction 44. Once the pressure in chamber 19 exceeds the combined force of spring 32 and pressure in chamber 20, spool 22 shifts to the right opening the secondary flow path as annular groove 30 opens into chamber 14. If the priority flow exceeds its preset flow, such as a reel motor overspeed condition, spool 22 moves further to the right and land 25 begins to meter and restrict the priority flow. If variable restriction 44 is completely closed, blocking all flow in the priority flow path, the pressure in signal line 42 drops essentially to zero and causes the pump to shift to standby or to whatever load is being held by motor 46.

However, the closing of variable restriction 44 also causes valve spool 22 to shift to the right due to the decrease in pressure in servo chamber 20, allowing the pump discharge to flow to secondary motor 48. With flow to secondary motor 48, variable restriction 50 now acts as the pump flow control via sensing line 56 and 42 thereby causing the pump flow rate to adjust accordingly.

When priority motor 46 is blocked, as for example when a piston in a cylinder is bottomed out, it becomes impossible to satisfy the flow requirements of restriction 44 thereby preventing any secondary flow to chamber 14 due to the leftward position of land 26. With motor 46 blocked and restriction 44 unsatisfied, pump 40 will go to its maximum pressure level. However, before reaching that level relief valve 54 in sensing line 42 will open and prevent the pressure in sensing line 42 from going above that level. Fixed restriction 52 in sensing line 42 prevents overflowing of relief valve 54 and keeps the pressure in line 42 from exceeding the relieving pressure of valve 54. As relief valve 54 opens, the pressure in sensing line 42 and servo chamber 20 stabilizes while the pump pressure continues to build. This creates an artificial pressure drop between servo chambers 19 and 20, since chamber 19 is exposed to the increasing pump discharge pressure while chamber 20 is being held at the present level of relief valve 54. this pressure differential causes spool 22 to shift to the right, opening pump inlet chamber 16 to secondary outlet chamber 14, even though the priority flow path is not being satisfied. Variable restrictions 44 and 50 could not only be closed-center control valves, but also could be fixed restrictions or open-center control valves.

As stated previously, the drawings and description relate only to the preferred embodiments of the invention. Since many changes, some of which have been mentioned, can be made in the structure of these embodiments without departing from the inventive concept, the following claims should provide the sole measure of the scope of the invention.

What is claimed is:

1. In a hydraulic circuit having a variable displacement automatically controlled pump supplying a priority motor and at least one secondary motor, and a metering orifice means positioned in the priority flow path, the improvement comprising a priority flow valve including:

an inlet chamber connected to the pump discharge;

a priority outlet chamber connected to the priority motor;

a secondary outlet chamber connected to the secondary motor;

valve spool means positioned by a control servo with opposing chambers;

spring means urging said spool means in one direction;

a first sensing line connecting one opposing chamber of the control servo to the pressure downstream of said metering orifice and to the pump control;

a second sensing line connecting the other opposing servo chamber to the pressure upstream of the metering orifice; the valve spool means having a first position blocking inlet flow to the secondary outlet chamber while opening inlet flow to the priority outlet chamber, the spring means urging the valve spool means toward the first position; the valve spool means having a second position opening the inlet flow to the secondary outlet when the pressure in the second sensing line exceeds the combined force created by the spring means and the pressure in the first sensing line.

2. In the hydraulic circuit as set forth in claim 1, including: a fixed restriction means in the first sensing line and a relief valve means in the first sensing line downstream of the fixed orifice set at a level lower than the maximum pressure compensating level of the pump whereby, when the priority motor is blocked, the pressure in the first sensing line drops below that in the second sensing line due to the relief valve, thereby causing the spool means to move to its second position even though the flow requirements to the priority motor are not being satisfied.

3. In a hydraulic circuit as set forth in claim 1, wherein the valve spool means has a third position opening the inlet flow to the secondary outlet and increasingly restricting inlet flow to the priority motor as the pressure in the second sensing line exceeds the pressure levels of the second spool position.

4. In the hydraulic circuit as set forth in claim 1, including: a second metering orifice means positioned in the secondary motor flow path; and a third sensing line connecting the pressure downstream of the second metering orifice to the flow compensator of the pump so that flow to the secondary motor also controls the flow level of the pump and check valve means in the first and third sensing lines preventing flow from the flow compensator of the pump to the priority and secondary flow paths respectively.

5. In a hydraulic circuit as set forth in claim 1, wherein the metering orifice means is a conventional control valve and the priority motor is a power steering motor.

6. In a hydraulic circuit as set forth in claim 1, wherein the automatic pump control is a pressure flow compensating system.

7. In a hydraulic circuit as set forth in claim 1, wherein the automatic pump control is a pressure compensated system.

8. In a hydraulic circuit utilized on a mobile vehicle having a variable displacement automatically controlled pump supplying a priority motor and at least one secondary motor, there being a metering orifice means in the priority flow path and the secondary flow path, the improvement comprising a priority flow valve including:

a body having a bore therein;

an inlet chamber intersecting said bore connected to the pump discharge;

a priority outlet intersecting said bore chamber connected to the priority motor;

a secondary outlet chamber intersecting said bore connected to the secondary motor;

valve spool means positioned in said bore by a control servo having opposing chambers;

spring means urging said spool means in one direction;

a first sensing line connecting one opposing chamber to the priority flow path downstream of said metering orifice means and to the automatic control of the pump;

a second sensing line connecting the other opposing chamber to the priority flow path upstream of said metering orifice means; the valve spool means having a first position blocking inlet flow to the secondary outlet chamber while opening inlet flow to the priority outlet chamber; the spring means urging the valve spool means toward the first position; the valve spool means having a second position opening the inlet flow to the secondary outlet when the pressure in the second sensing line exceeds the combined force as created by the spring means and the pressure in the first sensing passage; a fixed restriction means in the first sensing line and a relief valve means in the first sensing line downstream of the fixed orifice set at a level lower than the maximum pressure compensating level of the pump;

a second metering orifice means positioned in the secondary motor flow path and a third sensing line connecting the pressure downstream of the second metering orifice to the automatic control of the pump so that flow to the secondary motor also controls the flow level of the pump.

9. In a hydraulic circuit having a variable displacement automatically controlled pump supplying a priority motor and at least one secondary motor, and a metering orifice means positioned in the priority flow path, the improvement comprising a priority flow valve means which includes:

a control servo having opposing chambers for controlling said valve means;

an inlet chamber connected to the pump discharge;

a priority outlet chamber connected to the priority motor;

a secondary outlet chamber connected to the secondary motor;

a first sensing line connecting one opposing chamber of the control servo to the pressure downstream of said metering orifice and to the automatic control of the pump;

a second sensing line connecting the other opposing servo chamber to the pressure upstream of the metering orifice;

the valve means having a first position blocking inlet flow to the secondary motor while opening inlet flow to the priority motor when flow is insufficient to the priority motor; the valve means having a second position opening inlet flow to the secondary outlet chamber when the pressure in the second sensing line exceeds the combined force created by the spring means and the pressure in the first sensing passage.

10. In a hydraulic circuit as set forth in claim 9, wherein the metering orifice is a conventional closed-center control valve.

11. In a hydraulic circuit as set forth in claim 9, wherein the metering orifice means is a conventional control valve.

12. In a hydraulic circuit as set forth in claim 9, including a second orifice means in the secondary flow path and a third sensing line connecting the secondary flow path downstream of the second orifice means to the flow compensator of the pump.

* * * * *